United States Patent [19]

Klancnik

[11] 4,109,330

[45] Aug. 29, 1978

[54] INNERSPRING CONSTRUCTION

[75] Inventor: Alvin R. Klancnik, Park Ridge, Ill.

[73] Assignee: Sealy, Incorporated, Chicago, Ill.

[21] Appl. No.: 789,446

[22] Filed: Apr. 20, 1977

[51] Int. Cl.[2] ..... A47C 23/04

[52] U.S. Cl. ..... 5/267; 5/269

[58] Field of Search ..... 5/267, 369, 351; 267/92.31, 99; 140/3 CA, 92.3

[56] References Cited

U.S. PATENT DOCUMENTS

| | | | |
|---|---|---|---|
| 2,254,106 | 8/1941 | Krakauer | 5/269 |
| 2,644,174 | 7/1953 | Hood | 5/269 |
| 3,264,660 | 8/1966 | Goldmeyer et al. | 52/69 |
| 3,653,082 | 4/1972 | Davis | 5/269 |
| 3,864,765 | 2/1975 | Anonauer | 5/267 |

*Primary Examiner*—Casmir A. Nunberg

*Attorney, Agent, or Firm*—Hume, Clement, Brinks, William & Olds, Ltd.

[57] ABSTRACT

An improved mattress innerspring unit is provided which includes a plurality of rows of coil springs and a plurality of cross helicals which extend transversely of the rows of coil springs, lacing together adjacent terminal convolutions of the coil springs, wherein a welding means is provided to eliminate the tendency of the cross helicals to spin-out of the unit. Also provided is a method of constructing an innerspring unit which includes welding an end revolution of a cross helical to another component of the unit or to an adjacent cross helical revolution.

4 Claims, 7 Drawing Figures

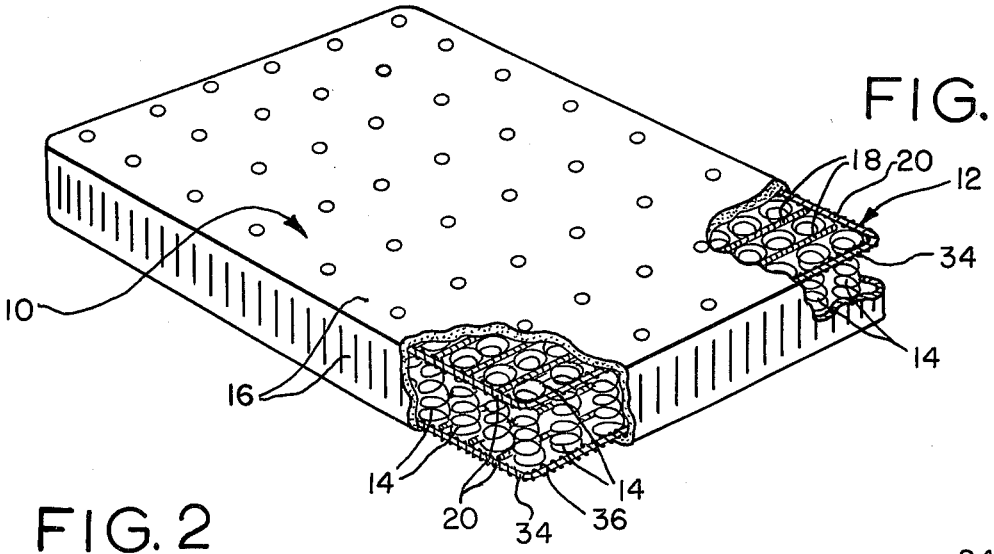
FIG. 1
FIG. 2
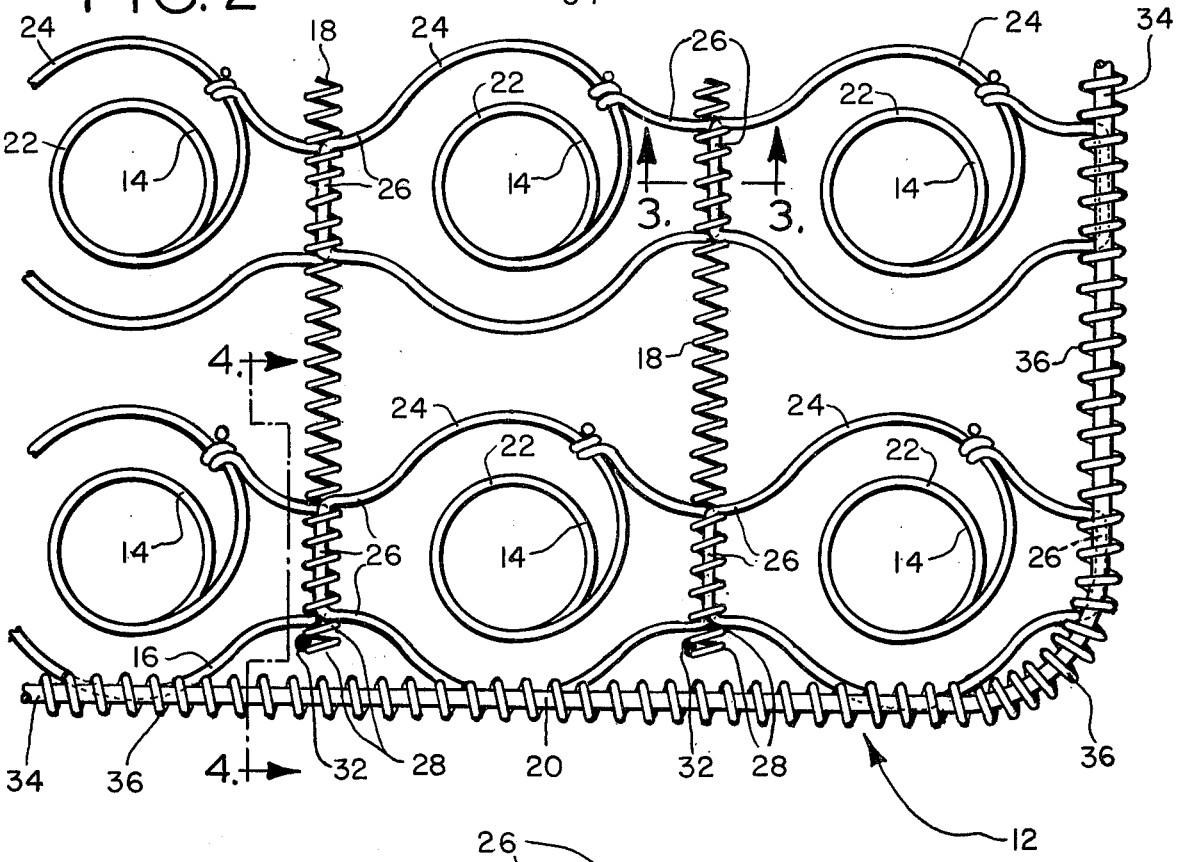
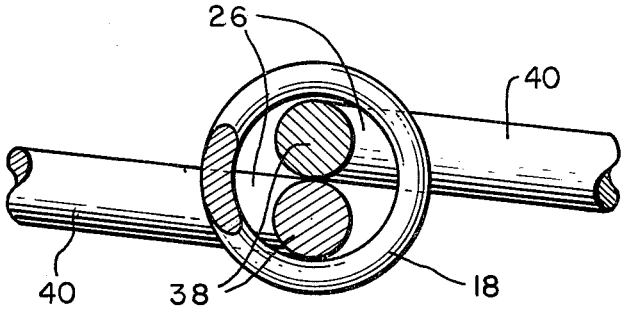
FIG. 3

FIG. 4
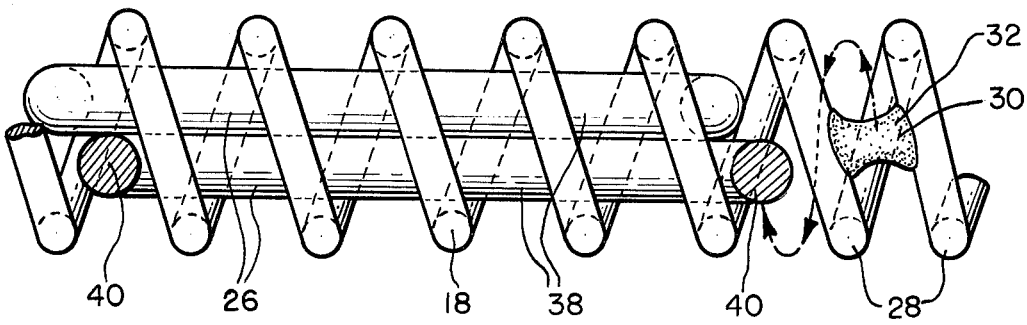
FIG. 5
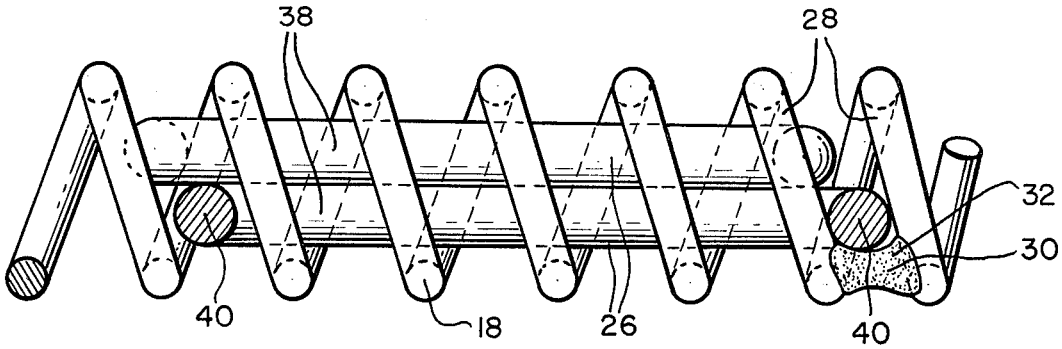
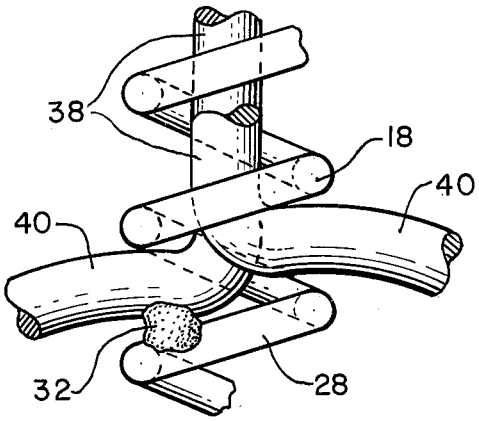
FIG. 7
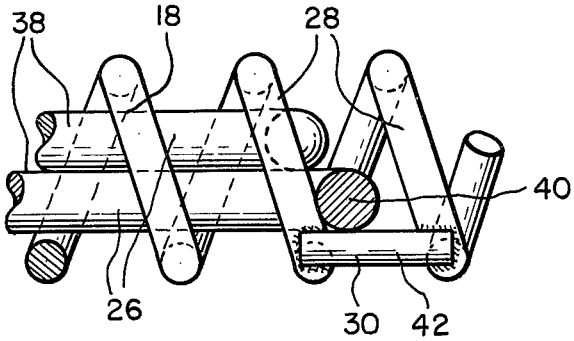
FIG. 6

INNERSPRING CONSTRUCTION

BACKGROUND OF THE INVENTION

This invention relates to an improvement in mattress innerspring units and, more particularly to a means for preventing the tendency of cross helicals to spin-out or unwind from the unit.

Mattress innerspring units are generally formed of a plurality of coil springs positioned standing side by side in a plurality of substantially parallel rows. The upper and lower surfaces of an innerspring unit are defined by the terminal or end convolutions of the coil springs which convolutions are generally closed loops that may be approximately circular or be formed so as to depart from the circular configuration by having two opposed U-shaped offset portions. The coil springs in any given row are normally positioned so that their terminal convolutions are in close relationship to terminal convolutions of adjacent springs in the same row. When the coil springs are formed with offsets, the springs are positioned so that offset portions are in close relationship to the offset portions of the adjacent coil springs.

The perimeter of the unit is generally defined by border wires connected to those coil springs which are positioned at the sides of the unit. When an innerspring unit includes two border wires, they are connected respectively to the upper and the lower terminal convolutions of the springs.

Coil springs are interconnected to adjacent coil springs in the same row by means of cross helicals which are spiral coils that extend transversely of the rows of springs and lace together adjacent coil springs at their terminal convolutions. The cross helicals therefore extend across the rows of coiled springs and interconnect adjacent coil springs in both the upper and lower surfaces of the innerspring unit. Innerspring units may include a plurality of cross helicals corresponding in number to twice the number of coil springs in a row of the unit minus two. Each cross helical is incorporated into the unit by rotating it spirally about its major axis until it extends transversely of the rows and interconnects, i.e. laces together, the terminal convolutions of adjacent coil springs. Once the cross helicals are so positioned, they have a tendency to "spin-out", that is, unwind from the innerspring unit.

To eliminate this undesirable longitudinal movement of the cross helicals, it has been the practice to deform the cross helicals in various manners. The ends of the cross helicals have been distorted by bending the ends back upon themselves or forming loops such as described in U.S. Pat. Nos. 3,006,629 and 2,374,850. Cross helicals have been distorted along their lengths to provide a deformity in the spiral as described in U.S. Pat. Nos. 3,685,062 and 3,653,082. U.S. Pat. No. 2,254,106 describes a further method of preventing longitudinal movement of cross helicals by providing frictional engagement of the helicals with the coil springs. Although these methods may reduce spinout, none have completely eliminated cross helical spin-out. Further, methods for preventing spin-out by deforming the cross helicals can be reduced in effectiveness when extreme conditions of use result in further cross helical deformation.

It is desirable that cross helicals be permanently secured to a mattress innerspring unit so that any tendency of the cross helicals to spin-out or unwind from the unit is eliminated even after extended use of unit. It is further desirable to construct an innerspring unit wherein cross helical spin-out is prevented by a method of construction that does not increase the cost of construction of the unit to any appreciable extent.

It is also often desirable to increase the firmness of an innerspring unit, that is, the ratio of compression of the coil springs to unit load.

It is therefore an object of the present invention to provide a mattress innerspring construction wherein cross helical spin-out is eliminated by providing a relatively permanent means for restricting the rotation of the cross helical. It is another object of the invention to provide a mattress innerspring construction including a welding means for restricting longitudinal movement of the cross helicals. It is also an object to provide an innerspring unit with a welding means that additionally increases the firmness of the unit. It is further object to provide a method of constructing a mattress innerspring unit including a welding means to prevent at least one cross helical from spinning-out of the unit.

SUMMARY OF THE INVENTION

The foregoing and other objects are realized in accord with the invention by providing a mattress innerspring unit including cross helicals which may extend several revolutions beyond the laced portion of the coil springs in the border rows at the longitudinal sides of the unit and at least one welding means for restricting the longitudinal movement of a cross helical. The welding means may be a weld that extends between a cross helical revolution and another component of the unit. The welding means may also be a weld that extends between adjacent cross helical revolutions.

The present invention includes a mattress innerspring unit wherein at least one cross helical has at least one of its revolutions welded to another component of the unit. A preferred embodiment of the present invention is a mattress innerspring unit wherein a plurality of cross helicals have at least one revolution at each of their ends welded to another component of the unit.

The present invention also includes a mattress innerspring unit wherein at least one cross helical revolution is welded to an adjacent cross helical revolution. A preferred embodiment is a unit where the adjacent welded cross helical revolutions are positioned beyond the laced portion of coil springs at a longitudinal side of the unit, which would facilitate quick assembly because the revolutions to be welded are readily assessable to the welding operations.

In all embodiments of the invention, longitudinal movement outwardly of the unit is prevented by the welding means.

A further preferred embodiment is an innerspring unit which includes cross helicals provided with welding means at each end which results in a substantially total restraint of movement of the cross helicals and increases the firmness of the unit because the restricted cross helicals will resist compressive forces applied to the unit, adding to the resistance provided by the coil springs.

The present invention also includes the methods of constructing such innerspring units.

The invention and its objects, methods of operation, features and advantages will be more fully understood by reference to the following drawings and the detailed description.

DESCRIPTION OF THE DRAWINGS

FIG. 1 is partially cutaway perspective view of a mattress with an innerspring unit embodying features of the present invention;

FIG. 2 is a sectional top view of a portion of the innerspring unit of FIG. 1 embodying features of the present invention;

FIG. 3 is a cross-sectional view of a portion of the innerspring unit of FIG. 2, taken along lines 3—3 of FIG. 2;

FIG. 4 is a cross-sectional view of a portion of the innerspring unit of FIG. 2, taken along 4—4 of FIG. 2;

FIG. 5 is a cross-sectional view of a portion of a cross helical and innerspring unit embodying features of the present invention illustrating the cross helical shown in FIG. 4 as it would be positioned subsequent to movement as suggested in FIG. 4;

FIG. 6 is a sectional side view of a portion of a cross helical and innerspring unit embodying features of the present invention; and FIG. 7 is a sectional top view of a portion of a cross helical and innerspring unit embodying features of the present invention.

DETAILED DESCRIPTION OF THE INVENTION

Referring now to the drawings, particularly FIG. 1, there is illustrated a mattress embodying features of the present invention, indicated generally by the reference numeral 10. The mattress 10 includes an innerspring unit designated generally 12. The innerspring unit 12 includes a plurality of coil springs 14 enclosed by a suitable mattress cover 16 and a plurality of cross helicals 18 which laced together adjacent coil springs 14. The cross helicals 18 are provided with welding means, as described in detail below, which prevent the cross helicals 18 from unwinding from the unit 12. Cross helicals 18, which are provided with welding means at each of its ends so as to restrict all longitudinal movement of such cross helicals 18, tend to resist compressive forces applied to the unit 12, increasing the firmness of the unit 12.

Referring now also to FIGS. 2 and 3, the innerspring unit 12 includes a plurality of coil springs 14 arranged in a plurality of substantially parallel rows. The rows of coil springs 14 extend parallel to the two longitudinal side borders 20 of the unit 12. The cross helicals 18 extend transversely of the rows of coil springs 14 from one longitudinal side border 20 to the other lacing together coil springs 14 which are adjacent to each other in the same row. The cross helicals 14 extend across the rows in both the upper and lower surface of the unit 12.

Each coil spring 14 is formed of a series of convolutions 22 that include two terminal convolutions 24 at its opposite ends which terminal convolutions 24 collectively define the upper and lower surfaces of the innerspring unit 12. The coil springs 14 are positioned so that their terminal convolutions 24 are in close proximity to the terminal convolutions 24 of adjacent coil springs 14 in the same row. The terminal convolutions 24 may be formed with two opposed U-shaped offsets 26 as best seen in FIG. 2. When the coil springs 14 are formed with offsets 26, they are disposed in each row so that the offsets 26 are in close proximity to the offsets 26 of adjacent coil springs 14.

The plurality of cross helicals 18, which extend across the rows of coil springs 14, lace together adjacent coil springs 14 in each row along their terminal convolutions 26 in both the upper and lower surfaces of the innerspring unit 12. When the terminal convolutions 24 have offsets 26, the cross helicals 18 lace together the terminal convolutions 24 along these offsets 26. The terminal convolutions 24 of course may have any other suitable configuration, such as substantially circular, and the selection of a suitable configuration is within the ordinary skill of one in the art. Although the cross helicals 18 lace together terminal convolutions 24 in both the upper and lower surface of the unit 12, FIG. 2 for simplicity shows only one of these surfaces, the other being substantially the same.

Each cross helical 18 is formed as a series of a revolutions 28 of a sufficiently large diameter that they can extend about a portion of two terminal convolutions 24 of adjacent coil springs 14 and yet of a sufficient small diameter that they hold these laced-together convolutions 24 in close proximity. The cross helicals are formed with a specific pitch i.e. distance between revolutions, which will vary depending upon the construction of the innerspring unit into which it will be incorporated. A typical cross helical may have a pitch of approximately one-fourth of an inch. The selection of a cross helical 18 with a suitable diameter and pitch is within the ordinary skill of one in the art.

The cross helicals 18 illustrated are of such length that several cross helical revolutions 28 extend beyond the laced portions of the coil springs 14 at both longitudinal side borders 20 of the innerspring unit 12. The cross helicals are provided with welding means, designated generally 30. As illustrated in FIG. 2, a weld 32 extends between two cross helicals revolutions 28 that are positioned beyond the laced portion of the coil springs 14 at a longitudinal side border 20 of the unit 12.

The innerspring unit 12 is illustrated as also including a pair of border wires 34 which extend around the periphery of the unit 12 in both the upper and lower surfaces thereof and are secured to the coil springs 14 positioned at the periphery of the unit 12 in any conventional manner which is well known to those of ordinary skill in the art. One method of securing the border wires 34, illustrated in FIGS. 1 and 2, is to lace the border wires 34 to the terminal convolutions 24 of the coil springs 14 at the periphery with spiral coils or border wire helicals 36. The welded cross helical revolutions 28 are disposed within the border wires 34.

The welds 32 bridging together adjacent revolutions 28 of the cross helicals 18 as illustrated in FIG. 2 are formed when two adjacent revolutions 28 are pinched together and welded along portions of their lengths which then lie in close proximity. By weld or welding, as used herein is meant any suitable means for or method of permanently joining metal pieces such as by resistance welding, arc welding, gas welding and the like. The selection of a suitable manner of welding and suitable equipment to form a suitable weld therefore is within the ordinary skill of one in the art. Moreover, any technique for permanently joining together metal suitable to effectuate bridging of a revolution 28 of a cross helicals 18 as described herein may be considered an equivalent of welding and is also contemplated by the present invention, as is the bridge formed thereby.

Referring now to FIGS. 4 and 5, there is illustrated closeup cross-sectional views of FIG. 2, showing single pairs of offsets 26 of terminal convolutions 24 of adjacent coil springs 14 which are laced together by a section of the cross helical 18. The offsets 26 are positioned in substantially overlapping relationship which reflects a desirable construction of an innerspring unit 12 in that the cross helical 18 prevents the overlapped offsets 26 from moving past each other, resulting in a greater firmness of the unit 12. The U-shaped offsets 26 each have a base portion 38 that is positioned within the circumference of the cross helical 18. The offsets 26 also have two side members 40 which extend between the revolutions 28 of the cross helical 18. FIGS. 4 and 5 illustrates the path the weld 32 will travel as the cross helical 18 rotates about its principal axis moving inwardly of the unit 12. FIG. 5 particularly illustrates the position of the revolutions 28 and weld 32 when the weld 32 contacts the nearest side member 40 of the offset 26. The weld 32 can not pass the side member 40, the longitudinal motion of the cross helical 18 is arrested, and the cross helical 18 is prevented from spinning-out at the opposite end of the unit 12.

The weld 32 bridges the space between the two cross helical revolutions 28 and provides a positive abutment which cannot pass the laced portion of the coil springs 14. The weld 32 at one end of the cross helical 18 prevents the cross helical from rotating outwardly at the opposite end of the unit 12 and two welds 32 at opposed ends of a cross helical 18 will restrict its longitudinal movement in either direction.

Referring now to FIG. 6, there is illustrated a portion of an innerspring unit with the welding means 30, which extends between two cross helical revolutions 28, which includes a piece of metal wire 42 welded at each end respectively to the two revolutions 28. The offsets 24 shown are disposed in overlapping relationship and each include a base 38 and side members 40. The bases 38 are disposed within the circumference of the cross helical 18 and one of the side members 40 is shown abutting the bridging wire 42 between cross helical revolutions 28, preventing rotation of the cross helical inwardly of the unit 12.

FIG. 7 illustrates a portion of a further embodiment of the present invention, an innerspring unit 12 including a welding means 30 which includes a weld 32 bridging a cross helical revolution 28 and another component of the unit 12, here the side member 40 of the offset 26. Again, longitudinal movement of the cross helical 18 is prevented by the welding means 30. In this embodiment, longitudinal movement of the cross helical 18 in either direction is prevented by a single weld 32. When a weld 32 of this embodiment is present at the other end of the cross helical 18, which is not illustrated because it is substantially the same, the cross helical 18 is held in relatively taut and will resist compressive forces applied to the unit 12, adding firmness to the unit 12.

When a cross helical 18 is provided with welding means 30 of any embodiment of the invention at both of its ends, it will be at least somewhat restricted with respect to horizontal movement and therefore provide some additional firmness, the extent of which will depend on the amount of rotation inwardly of the unit 12 at each end is allowed by the welding means 30 provided at that end. For instance, a welding means 30 which is a weld 32 between a revolution 28 and the side member 40 of an offset 26 allow almost no movement of the cross helical 18 inwardly while if it were a weld 32 between two adjacent revolutions 28 which extend a distance beyond the laced offsets 26, the cross helical 18 can move inward until the welding means 30 contacts the offsets 26.

This invention includes innerspring units 12 provided with welding means 30 at positions other than the longitudinal sides 20 of the units 12, such as any position between the ends of the cross helicals 18. Units 12 with welding means 30 near the ends of cross helicals 18 are preferred because such welding means 30 may be easily provided during the construction of the unit 12. That is, the cross helical revolutions 28 at the ends of the cross helicals 18 are easily assessible prior to addition of the border wires 34 and providing welding means 30 here will not add appreciably to the cost of construction of the unit 12.

The method of the present invention for constructing the innerspring unit 12 includes positioning the cross helicals 18 transversely of an assembly of rows of coils springs 14 to lace together the coil springs 14 of each row, welding the desired cross helical revolutions 28 by any means well known to those of ordinary skill in the art and securing the border wires 34 to the unit 12.

EXAMPLE I

Coil springs 14, representing the first and second springs 14 of each row of the unit 12 being constructed, are placed in pairs in a straight alignment. The terminal convolutions 24 of the coil springs 14 in each pair are in close proximity. Two cross helicals 18 are rotated about their major axes along the alignment so as to lace together the terminal convolutions 24 of each of the pairs. One cross helical 18 laces the upper terminal convolutions 24 while the other laces the lower terminal convolutions 24. Other coil springs 14 are then added to the alignment, one at the side of each laced pair, and are laced thereto in the same manner. This is repeated until the assembly is completed. Along one longitudinal side 20 of the unit 12, a revolution 28 of each cross helical 18 is welded to an adjacent coil spring 14 at any convenient point which preferably would be a portion of its terminal convolution 24. The border wires 34 are then secured to the unit 12 in any suitable manner which is well known to those of ordinary skill in the art.

EXAMPLE II

The procedure of EXAMPLE 1 is followed except that cross helical revolutions 28 at both longitudinal side borders 20 of the unit 12 are welded to adjacent coil springs 14.

EXAMPLE III

The procedure of EXAMPLE II is followed except that instead of welding the cross helical revolutions 28 to adjacent coil springs 14, two end revolutions 28 at each of the cross helicals 18 are pinched together and welded at a point where they are in close proximity.

EXAMPLE IV

The procedure of EXAMPLE II is followed except that instead of welding the cross helical revolutions 28 to adjacent coil springs 14, a separate length of wire 42 is extended across two end revolutions 28 at each end of the cross helicals 18 and is welded to both revolutions.

It will be understood that changes may be made in the details of construction, arrangement and operation without departing from the spirit of the invention, particularly as defined in the following claims:

I claim:

1. In a generally rectangular mattress innerspring unit, a spring structure comprising:

a. a plurality of coil springs positioned in a plurality of parallel rows, said springs each including an upper and a lower terminal convolution which terminal convolutions define an upper and a lower surface of the unit and are disposed in close proximity to the terminal convolutions of adjacent coil springs in the same row;

b. a plurality of cross helicals which extend transversely of the rows of springs in both the upper and lower surface of the unit, and lace together adjacent coil springs in each row; and c. at least one welding means for restricting the rotation of a cross helical about its major axis, which welding means extends between two adjacent revolutions of a cross helical, whereby cross helical spin-out is reduced.

2. The innerspring unit of claim 1 wherein the welded cross helical revolutions are disposed beyond the coil springs at the longitudinal side of the unit.

3. The innerspring unit of claim 2 wherein each cross helical is secured by welding means at least at one of its ends.

4. The innerspring unit of claim 3 wherein the terminal convolutions of the coil springs have opposed U-shaped offsets.

* * * * *